United States Patent [19]

Ketzinel et al.

[11] Patent Number: 4,599,221

[45] Date of Patent: Jul. 8, 1986

[54] RECOVERY OF URANIUM FROM WET PROCESS PHOSPHORIC ACID BY LIQUID-SOLID ION EXCHANGE

[75] Inventors: Zvi Ketzinel; Ygal Volkman; Moshe Hassid, all of Beer-Sheva, Israel

[73] Assignee: The State of Israel, Atomic Energy Commission, Nuclear Research Center Negev, Israel

[21] Appl. No.: 579,544

[22] Filed: Feb. 13, 1984

[30] Foreign Application Priority Data

Aug. 1, 1983 [IL] Israel ..... 69384

[51] Int. Cl.[4] ..... B01D 15/04; C01G 43/00

[52] U.S. Cl. ..... 423/7; 210/665; 210/682

[58] Field of Search ..... 423/7, 321 R; 210/682, 210/667, 665; 75/101 BE

[56] References Cited

U.S. PATENT DOCUMENTS 4,002,564 1/1977 Carbonel et al. ..... 210/688
4,256,702 3/1981 Lyaudet et al. ..... 423/7
4,321,235 3/1982 Mouret et al. ..... 423/7
4,432,944 2/1984 Elliott ..... 210/682

FOREIGN PATENT DOCUMENTS 2489711 3/1982 France ..... 210/682
52-44396 4/1977 Japan ..... 423/7
2084126 4/1982 United Kingdom ..... 210/682

*Primary Examiner*—Benoit Castel
*Attorney, Agent, or Firm*—Steinberg & Raskin

[57] ABSTRACT

Recovery of uranium from crude wet process phosphoric acid (WPA) by cation exchange using as cation exchanger a resin comprising active amino phosphonic or hydroxy phosphonic groups linked to a matrix. The operational steps comprise reduction of uranium in the WPA to the tetravalent state, contacting the WPA with the cation exchange resin to load the latter with tetravalent uranium, displacing $Fe^{+2}$ from the resin, washing the resin with aqueous ammonia, eluting the resin with a carbonate-bicarbonate solution and precipitating uranium from the eluate.

4 Claims, 1 Drawing Figure

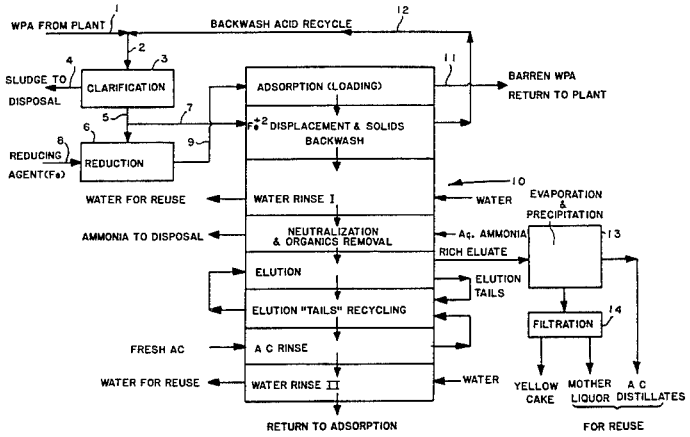

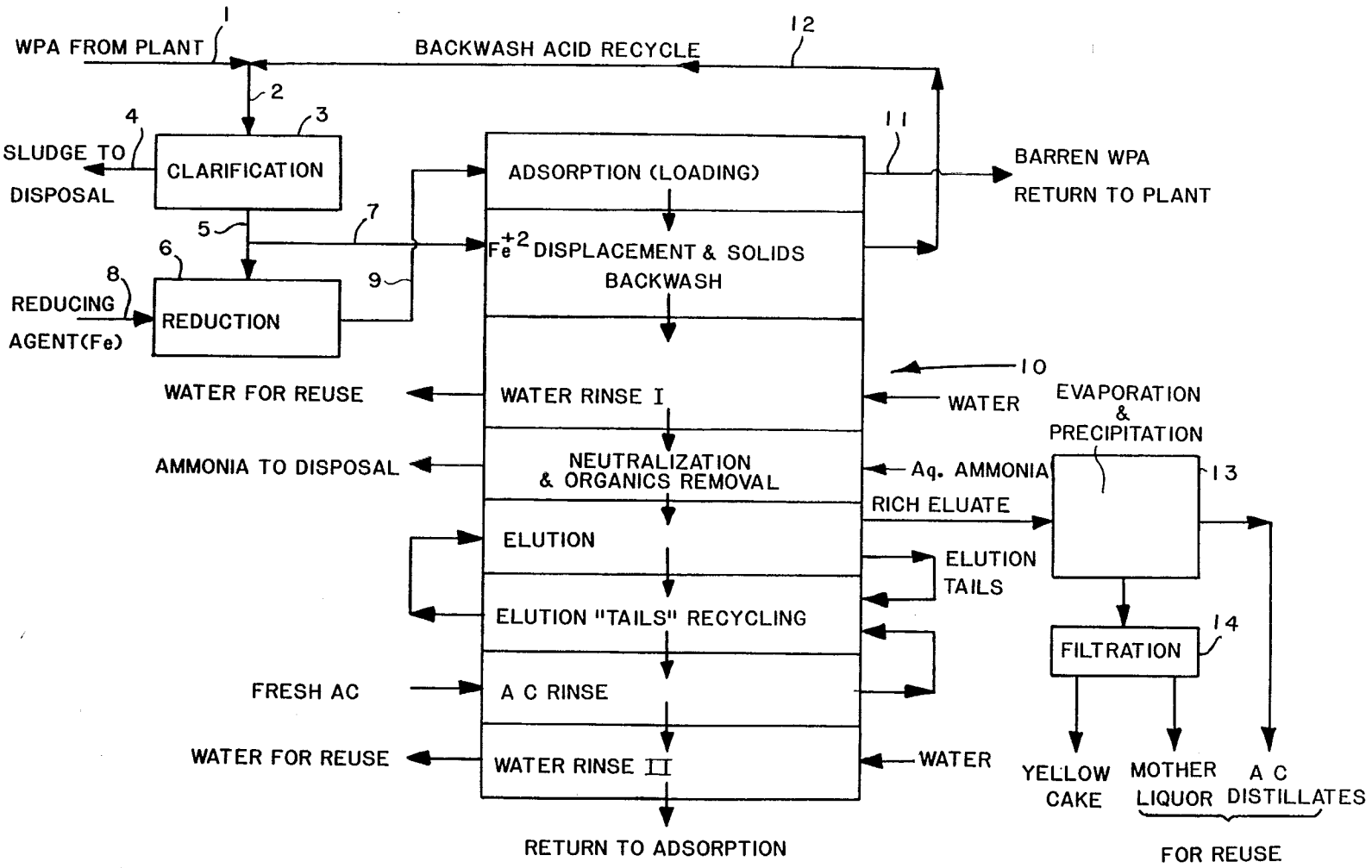
WPA FROM PLANT
1
2
CLARIFICATION
3
4
SLUDGE TO DISPOSAL
5
6
REDUCTION
7
8
REDUCING AGENT(Fe)
9
BACKWASH ACID RECYCLE
12
BARREN WPA RETURN TO PLANT
11
10
ADSORPTION (LOADING)
$Fe^{+2}$ DISPLACEMENT & SOLIDS BACKWASH
WATER RINSE I
NEUTRALIZATION & ORGANICS REMOVAL
ELUTION
ELUTION "TAILS" RECYCLING
A C RINSE
WATER RINSE II
RETURN TO ADSORPTION
WATER
Aq. AMMONIA
RICH ELUATE
ELUTION TAILS
WATER
WATER FOR REUSE
AMMONIA TO DISPOSAL
FRESH AC
WATER FOR REUSE
EVAPORATION & PRECIPITATION
13
FILTRATION
14
YELLOW CAKE
MOTHER LIQUOR
A C DISTILLATES
FOR REUSE

RECOVERY OF URANIUM FROM WET PROCESS PHOSPHORIC ACID BY LIQUID-SOLID ION EXCHANGE

BACKGROUND OF THE INVENTION

The present invention concerns a method for the production of uranium from rock phosphate.

Native rock phosphate contains as a rule uranium in an amount of from 100–200 ppm and various methods have been proposed in literature for the recovery thereof.

Phosphoric acid is produced from rock phosphate by the so-called wet process which comprises decomposition of the rock phosphate with aqueous sulfuric acid. The wet process has two modifications. By one of these, known as the dihydrate method, the calcium values of the native phosphate rock are precipitated in the form of calcium sulfate dihydrate $CaSO_4.2H_2O$, which produces a phosphoric acid of a concentration expressed in terms of $P_2O_5$ contents of up to about 27–32% by weight. By the other modification, known as the hemihydrate method, the calcium values of the native phosphate rock are precipitated in the form of calcium sulfate hemi-hydrate-$CaSO_4.\frac{1}{2}H_2O$ and this yields a phosphoric acid of a concentration of 40–45% by weight of $P_2O_5$. In either case the uranium values of the native rock are present in the crude wet process phosphoric acid and it is the object of the present invention to provide an efficient liquid-solid ion exchange method for the recovery of uranium from crude wet process phosphoric acid.

Current processes for the recovery of uranium from the wet process phosphoric acid (hereinafter for short WPA) are based on liquid-liquid extraction techniques which apply selective organic solvents such as, for example, octyl-pyrophosphoric acid known as OPPA, a mixture of di-(2-ethylhexyl)phosphoric acid and trioctylphosphine oxide in kerosene diluent known as DEHPH-TOPO or octyl phenyl phosphoric acid known as OPAP. By these processes uranium is recovered from crude 28–32% $P_2O_5$ WPA. Impurities in the WPA, mainly organic matter and finely dispersed solids, cause difficulties in the operation of these liquid-liquid extraction processes such as interfacial crud formation, hindered phase separation, solvent losses, and barren acid contamination with traces of solvents. Because of these problems, appropriate cleaning of the WPA prior and after the extraction of uranium therefrom is essential. However, this in turn renders the entire extraction process more complicated and expensive. Moreover, it has been found that by known extraction operations it is practically impossible to extract uranium efficiently from 40–45% $P_2O_5$ WPA obtained by the so-called hemihydrate wet process.

In view of the difficulties encountered in liquid-liquid extraction of uranium values from WPA, it has already been proposed to effect such recovery by means of liquid-solid ion exchange. The feasibility of a solid-liquid ion exchange reaction depends on the affinity between the solid ion exchanger and the ion to be removed from the solution, on the nature of such solution, on the capacity of the ion exchanger for the desired ion, and on the selectivity of the ion exchanger for the desired ion in the given system. Thus, while ion exchange resins are extensively used to recover uranium from sulfate media, attempts to develop industrial scale processes for the recovery of uranium from WPA failed because the available resins did not have enough capacity and selectivity for uranium. Thus for example, R. Derry in "The Recovery of Uranium from Phosphatic Sources in Relation to EEC", Report No. EUR-7324, pp. 24–27, EEC, Brussels (1981), describes some unsuccessful attempts for the recovery of uranium from wet process phosphoric acid by ion exchange and the state of the art is summed up on page 27 by the statement that "the lack of selectivity, however, still remains a problem area with ion exchange resins systems".

Another attempt at the extraction of uranium from a 30% $P_2O_5$ WPA by means of ion exchange is described by Irvin R. Higgins in a review paper entitled "Hydro Metallurgical Recovery of Metal Values by the Use of Ion Exchange". The American Institute of Chemical Engineers, Symposium Series, Vol. 78, No. 216 (1982) at page 147. According to that disclosure a weak base resin was used for the purpose and stripping was effected with aqueous $Na_2CO_3$ but, as the author states, the extraction coefficient was so low that prodigious amounts of $Na_2CO_3$ strip agent were required.

In U.S. Pat. No. 4,002,564 (Carbonet et al.) there is described a group of ion exchange resins comprising each a cross-linked vinyl-aromatic polymer carrying recurring active aminophosphonic units of the formula $—CH_2NHRPO(OH)_2$ wherein R is a lower alkylene radical. It is stated in the specification (column 1 lines 44–46) that such ion exchange resins are capable of selectively removing metallic ions from aqueous solutions and in column 3 lines 42–46 it is further stated that the removal of metallic ions from aqueous solution with the aid of these cation-exchange resin is "conventional in so far as operating conditions are concerned such as pH, temperature, concentration, and the like".

A related group of cation-exchange resin is described in French patent specification No. 2,489,711 to Minemet Recherche. The resins there described are characterised by active hydroxy phosphonic groups of the formula

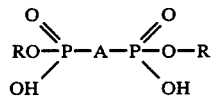

where R is propyl, isopropyl, ethyl, methyl or hydrogen and A is optionally substituted ethylene or methylene. On page 4 of the French specification it is mentioned that such a cation-exchange resin may be used for the recovery of uranium from phosphoric acid and that for this purpose it is required to contact the uranium bearing phosphoric acid with the resin, if desired after preliminary reduction, and then to elute the uranium in an oxidizing medium by means of an alkali or ammonium carbonate.

A particular resin out of the group of those disclosed in the said U.S. Pat. No. 4,002,564 has functional groups of the formula $—CH_2NH—CH_2—PO_3^{-2}$ which are attached to a macroporous polystyrene matrix and is known under the trade name Duolite ES 467 (Dia-Prosim). In a pamphlet dated August 1981 the manufacturers state with respect to this ion exchange resin that "uranium can be recovered from concentrated (30%) phosphoric acid solutions" but there is no teaching as to how this may be achieved.

Because of the close relationship between the cation exchange resins according to U.S. Pat. No. 4,002,564, including Duolite ES 467, and those of French Pat. No. 2,489,711 and seeing that neither the said U.S. patent nor the said pamphlet include any specific instructions as to how to recover uranium from WPA with the subject cation exchanger, attempts have been made by the present inventors to proceed in accordance with the teachings in French patent specification No. 2,489,711. Accordingly, crude WPA was subjected to reduction with iron powder so as to reduce the uranium from the hexavalent to the tetravalent state, the so-reduced WPA was then contacted with the resin and the loaded resin was eluted with aqueous sodium or ammonium carbonate. The results were very unsatisfactory and among the problems that were encountered there may be mentioned the fact that the organic matter in the crude acid fouled the resin and was in part carried over into the eluate thereby interfering adversely with the precipitation of the uranium product, the so-called "yellowcake". Moreover, the stripping coefficient of uranium with aqueous sodium or ammonium carbonate was low, which meant long tails and large volumes of eluate or low uranium concentration. Further difficulty was due to the fact that the acidic cation exchanger reacted with the carbonate eluting agent resulting in the formation of gaseous carbon dioxide which interfered adversely with the elution process.

SUMMARY OF THE INVENTION

It is the object of the present invention to provide an effective, industrially applicable process for the recovery of uranium from crude WPA by cation exchange.

It is a further object of the present invention to provide such a process applicable to crude WPA regardless of any concentration, including crude WPA obtained by the dihydrate process and having a $P_2O_5$ concentration of about 28–32% by weight, and a crude WPA obtained by the hemihydrate process and having a $P_2O_5$ concentration of about 40–45% by weight.

In accordance with the present invention there is provided a process for the recovery of uranium from crude wet process phosphoric acid (WPA) by cation exchange using as cation exchanger a resin comprising active amino phosphonic or hydroxy phosphonic groups linked to a matrix (hereinafter "cation exchange resin of the kind specified"), which process comprises:

(i) subjecting crude WPA to a reduction treatment thereby to reduce uranium from the hexavalent into the tetravalent state;

(ii) contacting the so-reduced crude WPA with a cation exchange resin of the kind specified thereby to load the latter with tetravalent uranium;

(iii) subjecting the so-loaded cation exchange resin to a treatment by which $Fe^{+2}$ is displaced from the resin;

(iv) thereafter subjecting the loaded resin to treatment with aqueous ammonia thereby to neutralize free acid groups present on said cation exchange resin and remove any organic matter;

(v) eluting the neutralized, loaded cation exchange resin with an aqueous solution of a mixture of carbonate and bicarbonate of ammonium or an alkali metal salt; and (vi) precipitating a uranium product from the resulting eluate.

It is preferred to subject the crude WPA to a clarification treatment prior to its being contacted with a resin of the kind specified, e.g. by filtration, by allowing solid matter to settle followed by separation of the supernatant crude acid, etc.

By the reduction operation of hexavalent uranium in the crude acid to the tetravalent state $Fe^{+3}$ present in the crude WPA is reduced into $Fe^{+2}$ which latter is thus present in the WPA charged into the process. The said reduction operation is preferably effected with iron powder which leads to the inclusion of additional amounts of $Fe^{+2}$ cations in the crude WPA that is charged into the process and contacted with a cation exchange resin of the kind specified, such additional $Fe^{+2}$ resulting from the oxidation of the iron powder. Upon contact of the reduced WPA with the cation exchange resin of the kind specified, $Fe^{+2}$ cations are present within the resin together with the loaded $U^{+4}$ cations and it is necessary to displace the $Fe^{+2}$ prior to elution. Such a displacement can be effected, for example with WPA containing $Fe^{+3}$, e.g. feed crude WPA or oxidized effluent WPA.

During the elution with said aqueous carbonate-bicarbonate solution the loaded $U^{+4}$ is oxidized into $U^{+6}$ and extracted in this form. Presumably oxygen dissolved in said solution is responsible for the oxidation.

If desired, any other mild oxidation method that does not adversely affect the cation exchange resin can be used.

It has further been found in accordance with the present invention that the best results are achieved if the cation exchange reaction between a cation exchange resin of the kind specified and reduced, crude WPA is effected at an elevated temperature of 60°–70° C. This is in fact a temperature at which WPA is obtained and because of the large volumes involved this temperature is retained by the crude WPA for a long time. In prior art liquid-liquid extraction processes which as a rule have to be carried out at about 40°–50° C., special, energy-consuming cooling operations are required while in accordance with the present invention no such cooling is needed, which constitutes yet another and significant advantage.

By the neutralization treatment with aqueous ammonia, the free acid groups of the ion exchange resin of the kind specified are neutralized, with the consequence that the carbonate-bicarbonate solution used for the elution is not decomposed.

Due to all the above-mentioned preliminary treatments, the stripping coefficient is high and there are practically no elution tails so that a relatively concentrated uranium eluate is obtained. Moreover, the said neutralizing treatment with aqueous ammonia also removes from said cation exchanger resin bed all the organics with the consequence that the uranium eluate obtained with said carbonate-bicarbonate solution is relatively pure.

From the uranium eluate obtained in the manner specified a uranium product is obtained by precipitation, preferably in evaporation precipitation.

BRIEF DESCRIPTION OF THE DRAWING

The accompanying drawing is a flow sheet of an embodiment of the present invention and it will now be briefly described, it being understood that the invention is not limited thereto.

DESCRIPTION OF THE PREFERRED EMBODIMENTS

WPA arriving from a phosphoric acid plant through a line 1 is conducted through a line 2 into a settler 3 for clarification. The sludge is withdrawn from settler 3 through line 4 while the supernatant, clear crude acid is withdrawn through line 5 and conducted into a reactor 6, part of the clear acid being tapped off through line 7.

Inside reactor 6 the clarified, crude acid is contacted with iron powder fed in at 8 whereby any hexavalent uranium is reduced into the tetravalent state with the simultaneous formation of $Fe^{+2}$. The so-reduced crude acid is fed through a line 9 into a column 10 holding a cation exchanger resin of the kind specified. For clarity of illustration the block signifying column 10 is divided into a number of sub-blocks each signifying one operational stage inside the column.

In the first operational stage the clarified and reduced crude WPA is contacted with a cation exchanger resin of the kind specified and barren acid depleted of uranium is withdrawn through line 11 and returned to the phosphoric acid plant. In the next following stage, clarified phosphoric acid tapped off through line 7 is charged into column 10 whereby any $Fe^{+2}$ cations present in the column are selectively displaced and the effluent from this operation is returned through a line 12 to the settler vessel 3.

There follows a water rinse for the removal of residual WPA, and thereafter a wash with aqueous ammonia whereby free acidic groups present in the cation exchanger are neutralized. This is followed by elution with an aqueous ammonium carbonate-ammonium bicarbonate solution, the rich eluate being withdrawn into an evaporation vessel 13 while any elution tails are recycled. There then follows a water wash to remove residual elution solution whereupon the cation exchanger resin of the kind specified inside column 10 is reconstituted for a new operational cycle.

Inside vessel 13 the eluate arriving from column 10 is subjected to evaporation by which $NH_3$ and $CO_2$ are expelled from this solution whereupon a uranium product presumably $UO_3.2H_2O$, a so-called "yellow cake", precipitates. The resulting slurry is charged into a filter 14 which retains the uranium product while the mother liquor is combined with the condensed distillate from the evaporation operation in vessel 13 and is recycled.

The invention is further illustrated by the following examples which describe several features thereof.

GENERAL PROCEDURES

A series of identical ion-exchange fixed-bed columns have been installed. Each column was made of transparent PVC tubes having a diameter of 2.5 cm and height of 130 cm. The columns were equipped with heating jackets through which a stream of controlled temperature water was circulated.

Solutions were introduced into the columns with dosing pumps.

Each column was filled with 500 ml of an ion exchange resin comprising a polystyrene resin and $—CH_2—NH—CH_2—PO_3^{-2}$ active groups sold by Dia-Prosim, France under the trade mark DUOLITE ES-467. The volume figure refers to a settled bed of the resin measured in its $Na^+$ form (as supplied).

All measurements are related to this volume as a fixed reference point, because volume variations take place when the resin changes its ionic form during the process cycle. Adsorption-elution cycles have been performed under different experimental conditions.

Sometimes, bath equilibrations have been done with the resin and process solutions. In this case, measured quantities of resin and WPA were charged into a plastic flask and placed in a thermostated shaker for the required period of time.

Wet-process phosphoric acid, containing 28–29% $P_2O_5$, which was produced in the plant of Rotem Fertilizers Ltd. from domestic phosphate rock, was used for the experiments. This acid is known to have relatively high, organics content and is very difficult to handle by conventional processes. Higher concentration samples were produced by evaporation. Uranium content of the acid varied between 160 to 180 mg/l. The WPA was reduced by addition of iron powder in a stirred vessel, in each experiment. Chemically pure reagents were used to prepare solutions for the elution stage.

EXAMPLE 1

Effect of WPA Concentration

Samples of 500 ml of reduced phosphoric acid of different $P_2O_5$ content have been equilibrated with samples of 10 g of resin Duolite ES-467 for 3 hours in a thermostated shaker. The uranium content of the phosphoric acid was analyzed before and after the equilibrations, and the percentage of uranium that was extracted by the resin was calculated from mass balance. The results are summarized in the following Table 1:

TABLE 1

Effect of phosphoric acid concentration on the extraction of uranium with Duolite ES-467

| Phosphoric acid conc. (M) | (% $P_2O_5$) | Temp. (°C.) | Initial U conc. (mg/l) | % U extracted (%) |
|---|---|---|---|---|
| 5.3 | 30 | 45 | 192 | 72 |
| 7.1 | 38 | 45 | 200 | 51 |
| 10.1 | 48 | 45 | 217 | 34 |
| 5.1 | 29 | 60 | 220 | 76 |
| 7.1 | 38 | 60 | 200 | 55 |
| 10.1 | 48 | 60 | 217 | 39 |

It is concluded from these results that $P_2O_5$ concentration adversely affects the efficiency of extraction. However, the results are still in the practical range.

EXAMPLE 2

Effect of Temperature

The beneficial effect of the temperature on the extraction of uranium can be seen from the results in Table 1.

In another experiment, reduced WPA was fed to two identical ion-exchange columns at a rate of 800 ml/hr (1.6 BV/hr-BV=bed volume). The first column was operated at 40° C. and the second at 60° C. Breakthrough of uranium occurred after the passage of 3000 ml (6 BV) in the first column and 9000 ml (18 BV) in the second, indicating improved adsorption at higher temperatures.

EXAMPLE 3

Procedure of Elution

An ion-exchange column was loaded with uranium by feeding it with reduced WPA at 60° C. Loading was continued until saturation of the resin. At this point, the column was loaded with 2.5 g of uranium. After rinsing with 1500 ml of water, elution with a solution of ammonium-carbonate (60 g/l) commenced. The colour of the solution that emerged from the column was dark brown, indicating the presence of organic matter. Gas bubbles within the column produced "bumps" and cavities in the resin bed.

In another experiment, uranium was loaded on an ion-exchange column using the same procedure. After water rinse, the column was fed with an aqueous solution of ammonia (3N) at a rate of 500 ml/hr (1 BV/hr). The ammonia solution that left the column had a dark brown colour which became lighter as streaming of ammonia through the column proceeded. After the passage of 2000 ml of ammonia, an equimolar solution of ammonium carbonate and ammonium bicarbonate (60 g/l total) was fed for eluting the uranium. The light brown colour of the emerging stream disappeared and changed to strong yellow, indicating the presence of uranium. These observations were verified by chemical analysis, which is summarized in the following Table 2:

TABLE 2

Comparison of Elution Procedure

| Elution Procedure | Concentration in outlet streams* Organic carbon | Uranium |
|---|---|---|
| (a) ammonium carbonate only | 2000 | 3200 |
| (b) aqueous ammonia rinse | 1700 | Nil |
| ammonium carbonate-bicarbonate | <100 | 3000 |

*The above-stated concentrations are expressed in mg/l and refer to the first bed-volume (500 ml) of each stream, which is the "core" of the elution.

EXAMPLE 4

Effect of Organic Matter on "yellow-cake" precipitation

This example demonstrates the adverse effect that organic matter has on the precipitation of "yellow-cake" from carbonate solutions. Although not specific for the ion-exchange process, this example is brought to emphasize the importance of our new elution procedure which produces organics free eluates (Example 3).

The common procedure to precipitate uranium from loaded ammonium-carbonate solutions is based on evaporation of the solution. At about 90° C., boiling begins and ammonia and carbon dioxide (which are the components of ammonium carbonate) evolve. As their concentration in the mother liquor decreases, the boiling point rises and the pH of the solution decreases, thus causing precipitation or uranium (probably as $UO_3.2H_2O$). When about 20% of the original volume of the solution is evaporated, the pH becomes constant (about 7) and no more uranium is further precipitated.

In our experiments, two samples of ammonium carbonate eluates, containing about 3000 mg/l uranium and different organics concentrations, were subject to the precipitation procedure which was previously described. The organics content and the uranium concentrations before and after precipitation have been analyzed and summarized in the following Table 3:

TABLE 3

Effect of Organics on "yellow-cake" precipitation

| Organic carbon in the eluate (mg/l) | Uranium concentrations in solution before evaporation (mg/l) | after evaporation (mg/l) |
|---|---|---|
| 350 | 2800 | 620 |
| <100 | 3000 | 94 |

EXAMPLE 5

Pre-elution treatments ($Fe^{+2}$-displacement and oxidation)

Three ion-exchange columns were loaded with uranium s described in the preceding examples. The first column was then treated with crude WPA which contained about 2 g/l of $Fe^{+3}$ until total displacement of the adsorbed $Fe^{+2}$. The second column was treated with WPA containing 6 g/l of $Fe^{+3}$ until total displacement of $Fe^{+2}$. The third column was left untreated.

The columns were then washed with water, neutralized with aqueous ammonia and eluted with ammonium carbonate-bicarbonate solutions according to the procedure outlined in Example 3. The results are summarized in the following Table:

TABLE 4

Comparison of pre-elution treatments

| Type of pre-elution treatment | Uranium eluted in the first bed volume of eluate (% of total) | Number of bed volumes for complete elution of uranium |
|---|---|---|
| No treatment | 54% | >5 |
| $Fe^{+2}$ displacement with WPA containing 2 g/l $Fe^{+3}$ | 72% | 3 |
| $Fe^{+2}$ displacement with WPA containing 6 g/l $Fe^{+3}$ | 95% | <2 |

We claim:

1. A process for the recovery of uranium from crude wet process phosphoric acid (WPA) by cation exchange using as cation exchanger a resin comprising active amino phosphonic or hydroxy phosphonic groups linked to a matrix, which process comprises:

(i) subjecting crude WPA to a reduction treatment thereby to reduce uranium from the hexavalent into the tetravalent state;

(ii) contacting the so-reduced crude WPA with said cation exchange resin thereby to load the latter with tetravalent uranium;

(iii) subjecting the so-loaded cation exchange resin to a treatment by which $Fe^{+2}$ is displaced from the resin;

(iv) thereafter subjecting the loaded resin to treatment with aqueous ammonia thereby to neutralize free acid groups present on said cation exchange resin and remove any organic matter;

(v) eluting the neutralized loaded cation exchange resin with an aqueous solution of a mixture of carbonate and bicarbonate of ammonium or an alkali metal salt; and (vi) precipitating a uranium product from the resulting eluate.

2. A process according to claim 1 wherein said crude WPA is subjected to a clarification treatment prior to being contacted with said resin.

3. A process according to claim 1, wherein WPA contacting $Fe^{+3}$ is used for said $Fe^{+2}$ displacement operation.

4. A process according to claim 1 wherein hot crude WPA is used having a temperature of 60°–70° C.

* * * * *